United States Patent [19]

Will et al.

[11] 4,051,414

[45] Sept. 27, 1977

[54] MISSILE ADAPTATION KIT ASSEMBLY

[75] Inventors: Albert S. Will, Bethesda; Robert R. Wilson, Chillum; Samuel J. Black, Silver Spring, all of Md.

[73] Assignee: The United States of America as represented by the Secretary of the Navy, Washington, D.C.

[21] Appl. No.: 423,643

[22] Filed: Dec. 28, 1964

[51] Int. Cl.[2] ..... H02B 1/04

[52] U.S. Cl. ..... 361/415; 339/176 M; 174/50; 361/419

[58] Field of Search ..... 174/50, 69; 317/101, 317/118, 101 CC, 101 D, 101 DH; 102/92.5; 114/20; 339/176 MD, 176 LM, 176 M; 325/352, 355

[56] References Cited

U.S. PATENT DOCUMENTS

| | | | |
|---|---|---|---|
| 2,948,126 | 8/1960 | Woodward | 102/92.5 |
| 2,976,806 | 3/1961 | Risk et al. | 102/92.5 |
| 3,027,417 | 3/1962 | Turner | 174/69 |
| 3,188,523 | 6/1965 | Yunghurth | 317/101 |

*Primary Examiner*—Nelson Moskowitz

[57] ABSTRACT

A high density component assembly package for a missile including a plurality of circular bulkheads axially supported by rigid spacing members to form a cylindrical adaption kit. Electronic components are mounted on and/or between the bulkheads with the electrical interconnections therebetween accomplished by the use of flat printed cables wrapped around the periphery of the assembly.

7 Claims, 10 Drawing Figures

INVENTORS
ALBERT S. WILL
ROBERT R. WILSON
SAMUEL J. BLACK

BY N. Jonnfeld ATTORNEY
Robert P. Williams AGENT

INVENTORS
ALBERT S. WILL
ROBERT R. WILSON
SAMUEL J. BLACK
BY M. J. Moorfield ATTORNEY
Robert P. Williams AGENT

INVENTORS
ALBERT S. WILL
ROBERT R. WILSON
SAMUEL J. BLACK

BY M. Yaworsky ATTORNEY
Robert P. Williams AGENT

INVENTORS
ALBERT S. WILL
ROBERT R. WILSON
SAMUEL J. BLACK

BY W. J. Mansfield ATTORNEY
Robert P. Williams AGENT

INVENTORS
ALBERT S. WILL
ROBERT R. WILSON
SAMUEL J. BLACK

BY N. Jmonfeld ATTORNEY
Robert W. Williams AGENT

MISSILE ADAPTATION KIT ASSEMBLY

The invention described herein may be manufactured and used by or for the Government of the United States of America for governmental purposes without the payment of any royalties thereon or therefor.

This invention relates to missile structure. More particularly, the invention relates to an improved package and structural mounting scheme for electrical and electronic components of a missile which, in its normal mode of operation, experiences difficult flight conditions and high shock loadings.

The invention has particular application to the SUBROC missile, which is an antisubmarine weapon, armed with a nuclear depth charge and designed to be launched from a standard torpedo tube of a submerged submarine to fly a water-air-water trajectory to the vicinity of the target. The SUBROC missile has a rocket motor and warhead section separable from each other after burnout of the motor, the warhead section flying on toward the target and re-entering the water. Severe shock loadings are experienced by the warhead section during the re-entry phase of the flight. It was therefore required that the electronic and electrical devices in the missile, and particularly the arming and fuzing devices, be rugged enough to withstand these shock loadings and to remain operative throughout the entire flight. By way of illustration, the present application describes the structure of the SUBROC arming and fuzing system or, as it will be hereinafter termed, the adaption kit, which structure has been shown to be capable of meeting this requirement.

Another problem which was encountered in the development of the present invention was a severe limitation on size and weight. As indicated by the fact that the entire missile must fit within a standard sized torpedo tube, between its inner and outer doors, the space allotted to the adaption kit was quite small. It was also required that weight be kept to a minimum. Complicating the problem was the fact that the adaption kit was required to perform about fifty different safing functions. Moreover, the entire system has to be provided in duplicate to provide for increased reliability.

Accordingly, it is an object of the invention to provide a structural arrangement for the arming and safing system of a missile which is strong and rugged and thus capable of withstanding severe shock effects.

Another object of the invention is to provide a mechanical package for electrical equipment in a missile, which package provides a highly efficient utilization of a limited cylindrical space.

A further object of the invention is to provide a mechanical package for electrical equipment which will have not only the attributes mentioned in the foregoing statements of objects but will also make provision for easy access of all of a large number of electrical connections to enable testing and troubleshooting of the equipment, as well as ease of assembly.

Another object of the invention is to provide an electrical package in a leakproof pressure hull wherein provision is made for a removable battery power supply while retaining the leakproof character of the hull to enable storage of the device with a protective inert atmosphere therein and with the battery power supply removed.

The objects of the invention are accomplished by the various novel features of the structure to be described below. For example, the assembled adaption kit is secured in the hull of the missile in such a way that the transmission of shock and vibration from the hull to the adaption kit is minimized. In order to maximize the efficiency of the use of space, the package has a high density cylindrical component arrangement in which most electrical connections are placed around the periphery of the cylinder and are thus easily accessible. Electrical interconnection is accomplished by the use of flat printed cables wrapped around the periphery of the assembly, an arrangement which occupies very little space.

Other objects, advantages and new features of the invention will become apparent from a consideration of the following detailed description when considered in conjunction with the accompanying drawings wherein.

Figure 1:
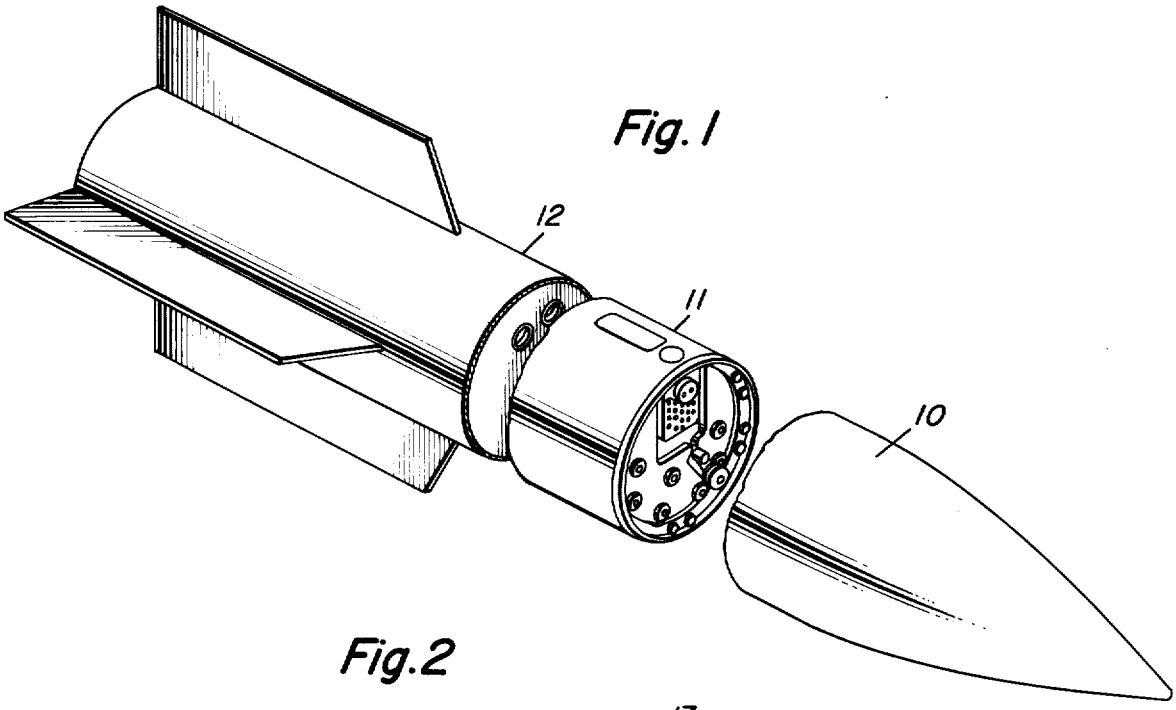
FIG. 1 is a diagrammatic exploded view of a missile warhead section, showing the location of the structure of the present invention.

FIG. 1 generally illustrates a missile with which the present invention may be used. As indicated above, this missile may be the SUBROC missile although it is to be understood that the general configuration as shown in FIG. 1 is not necessarily that of SUBROC. The missile consists of a warhead 10, the adaption kit 11, and the rear guidance and control section 12. The sections 10, 11 and 12 are secured together by suitable clamp bands, in a manner similar to the assembly of the hull sections of a conventional torpedo, in order to provide a continuous outer shell for the missile. The entire assembly as shown in FIG. 1 may be mounted at the forward end of a suitable rocket motor for propelling the weapon to the target. It is to be understood that the structure of FIG. 1 is, in its normal operation, intended to plunge into the water at an extremely high rate of speed, producing an extremely high shock on the missile structure.

FIG. 1 should also suggest the space limitations which had to be met by the present package. As is now publicly known, the SUBROC missile is launched from a torpedo tube of the attacking submarine and obviously must fit therewithin prior to launch. Thus the outside diameter of the missile shown in FIG. 1 must be materially less than the internal diameter of a standard torpedo tube. In fact, it is about 13 inches. The length of the adaption kit section as suggested from FIG. 1 is also quite limited, being about 18 inches. Into this small volume is packaged the entire arming, fuzing and safety system for the missile, in duplicate.

Figure 2:
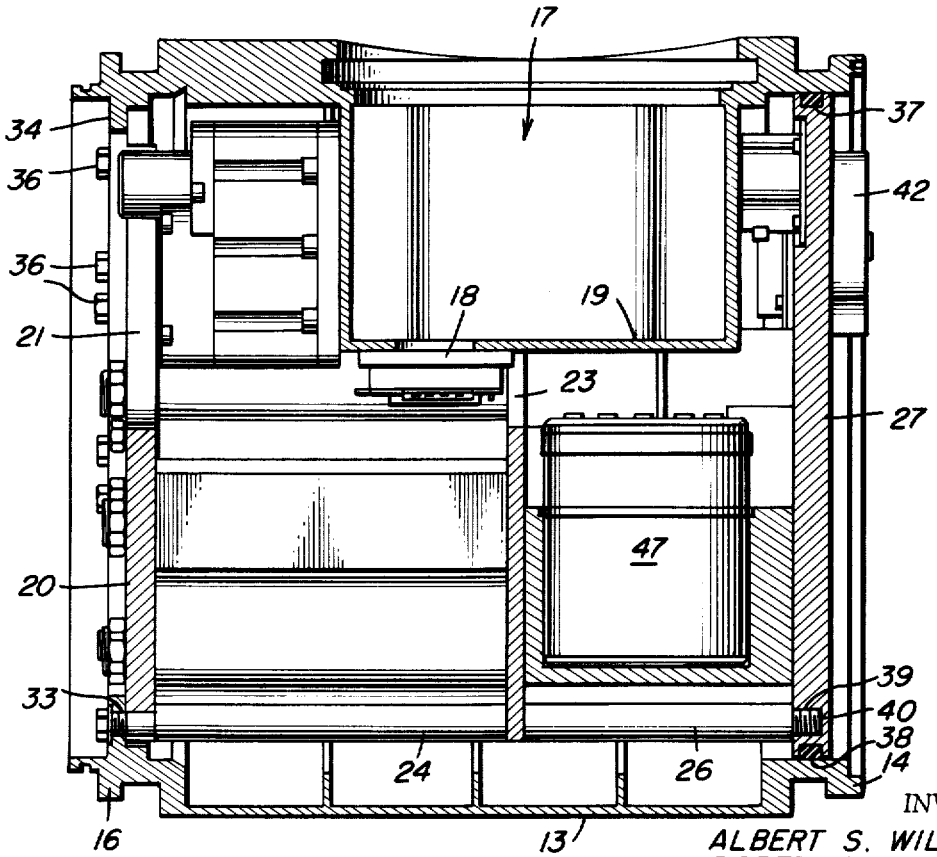
FIG. 2 is a cross-section through the present mechanical package taken on the line 2—2 of FIG. 3.

FIG. 2 illustrates the relationship between the adaption kit structure per se and the outer pressure hull 13 of the missile. At each end thereof, hull 13 is provided with annular flanges 14 and 16 which are configured to cooperate with clamp rings, not shown, for the purposes of securing the various hull sections together. In order to provide a readily removable battery power supply, the hull section is provided with a battery well 17 having walls thereof integrally secured to the hull, the well extending in toward the center of the hull and opening to the outside. A female electrical connector 18 is located in the bottom wall 19 of the well to enable electrical connection to the battery when it is placed into the well. Bottom wall 19 is integrally secured to the side walls of the well. Connector 18 is also designed to be leakproof so that a continuous leakproof envelope is provided. This construction allows the missile to be stored with a protective inert atmosphere therewithin even when the battery has been removed for purposes of safety. It should be here noted that electrical connector 18 is electrically connected to the other circuitry before the package is inserted in hull 13. After the package is put in place, connector 18 can be manipulated, from outside the hull, into its position in the bottom wall 19 and secured there in sealed relation.

Figure 4:
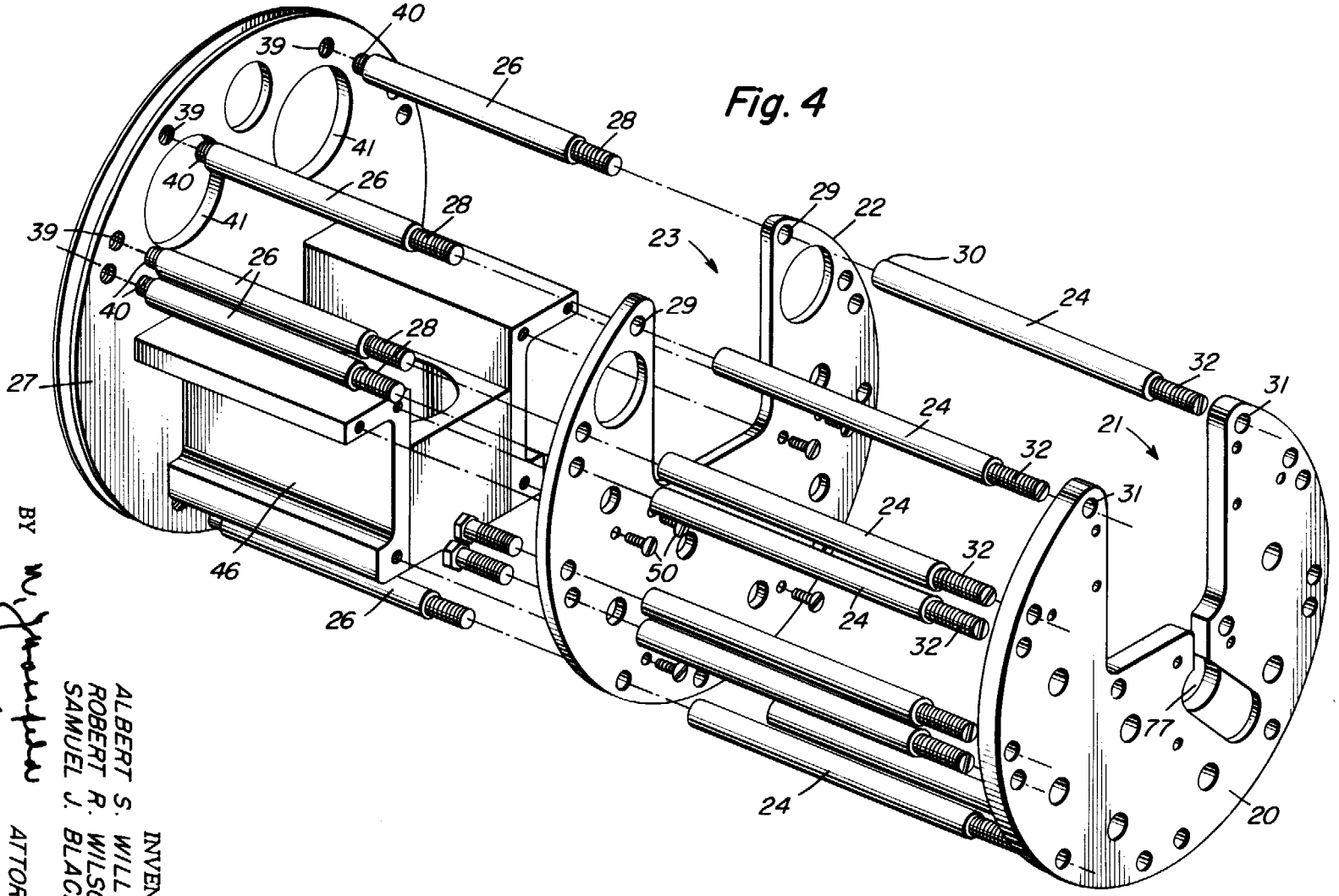
FIG. 4 is an exploded view of the supporting frame.

The adaption kit assembly itself is configured to be inserted into the pressure hull from the right as seen in FIG. 2. Reference is also directed to FIG. 4 with regard to this structure. The basic supporting frame of the adaption kit assembly consists of a forward plate or bulkhead 20 having a cut-out portion 21 therein to allow the plate 20 to pass the battery well 17. A central plate 22 is provided with a similar cut-out portion 23 and is separated from forward plate 20 by a plurality of spacer posts 24. Separated similarly from central plate 22 by posts 26 is an aft bulkhead 27. The order of assembly of these elements will be described below, after the relative arrangement of components within the adaption kit has been described. Suffice it to say at this point that post 24 and 26 are threadedly engaged with one another, post 26 having a male threaded portion 28 at one end thereof which passes through an opening 29 in central plate 22 and enters a female threaded portion in the end 30 of post 24, posts 26 and 24 thereby clamping plate 22 between them. After all of the components have been assembled between the plates 20, 22 and 27 in a manner to be later described, plate 20 is assembled by placing it on posts 24 so that holes 31 in plate 20 are received by threaded portions 32 on post 24. The entire assembly is then slid into the hull 13 and the threaded ends 32 of posts 24 are introduced through holes 33 in an internal annular flange 34 on the hull 13. The assembly is then secured in place in the hull 13 by means of nuts 36 threaded onto ends 32 of shafts 24.

At the opposite end of the adaption kit assembly at bulkhead 27, the adaption kit is not secured to the hull 13. Bulkhead 27 is provided with a peripheral groove 37 in which is seated an O-ring 38 to provide a pressure seal between bulkhead 27 and hull 13. O-ring 38 cooperates with that portion of the internal cylindrical surface of hull 13 immediately adjacent annular flange 14, extends substantially beyond bulkhead 27 at either side thereof in the axial direction to allow relative movement between the bulkhead 27 and the hull 13. This is an important feature of the present invention. When the missile plunges into the water, the hull 13 is subjected to a shock loading in the axial direction which produces, initially, a foreshortening or buckling of the hull which would be analogous to what would happen if the hull were put under axial compression. After the shock loading diminishes, the hull returns toward its initial shape. It should be apparent then that the motions of the hull relative to the adaption kit package due to the shock of re-entry impose minimal stresses on the package.

The construction and assembly of the adaption kit package itself will now be described, reference being directed to FIGS. 4–9 in particular. Assembly of the package begins with bulkhead 27. As seen in FIGS. 2 and 4 this bulkhead is provided with a plurality of tapped openings 39 adapted to receive the male threaded ends 40 of posts 26. Bulkhead 27 is also provided with two through holes 41 into which are secured the electrical connector elements 42 (see FIG. 9) to enable electrical connection with the electrical components in the guidance section 12. Also secured to aft bulkhead 27 as seen in FIG. 9 are some electronic modules 43 and an electrical component 44, as well as a supporting frame 46 for a gyro 47 and other elements. Each of the above mentioned modules and components is secured to aft bulkhead 27 by means of suitable fasteners.

Figure 8:
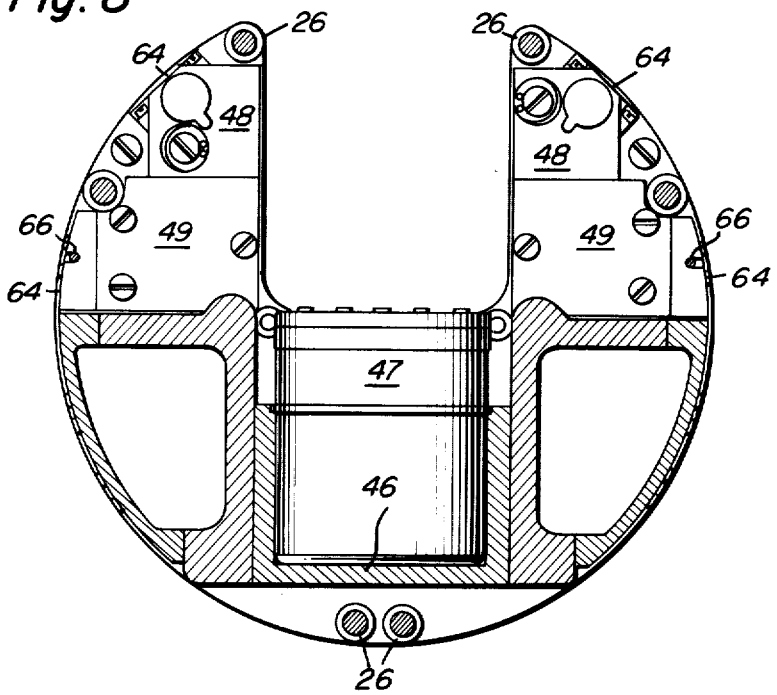
FIG. 8 is a cross-sectional view taken on line 8—8 of FIG. 5.
Figure 9:
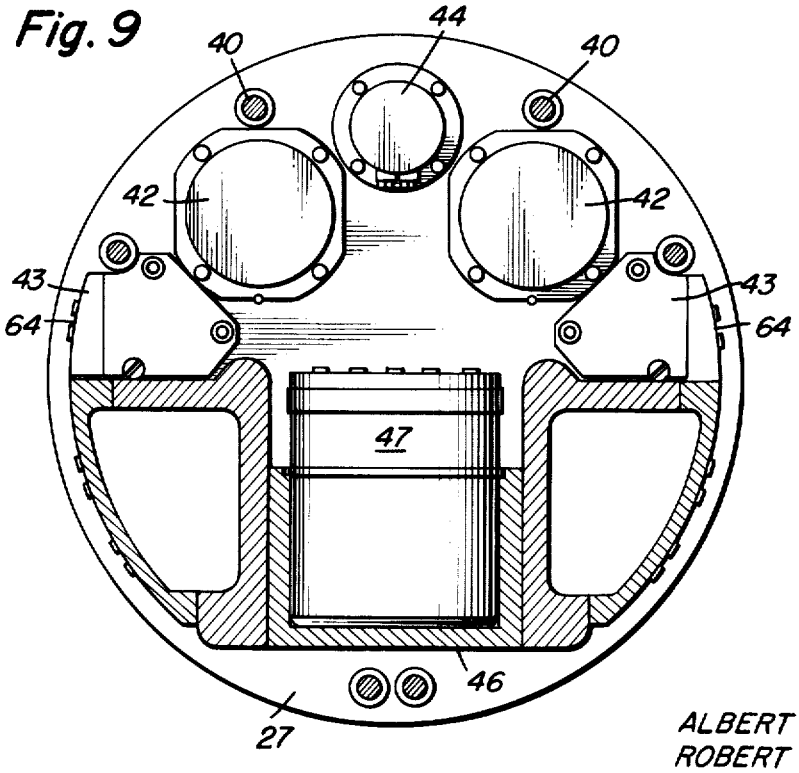
FIG. 9 is a cross-section on line 9—9 of FIG. 5.

FIG. 8 shows the assembly on the rear side of central plate 22. Before assembly of central plate 22 onto posts 26, certain components, as generally shown at 48 and 49 are secured to the rear side thereof. It is here noted that the same reference numerals have been applied to elements symmetrically disposed with respect to the vertical axial plane of the device in order to point out that these elements are similar. As noted above, the complete arming and safing system is duplicated in the present package in order to provide reliability in the case of failure of components in one or the other channel. After elements 48 and 49 have been secured to the rear side of central plate 22, it is put into place with the male threaded portions of posts 26 passing through the peripheral holes 29 in the central plate. Fasteners such as those indicated at 50 in FIG. 4 are then passed through suitable openings in central plate 22 into tapped holes in bracket 46, thus securing central plate 22 in place. Bracket 46 is also secured into plate 27 through counter bored holes in bracket 46 using bolts which engage tapped holes in plate 27.

Figure 3:
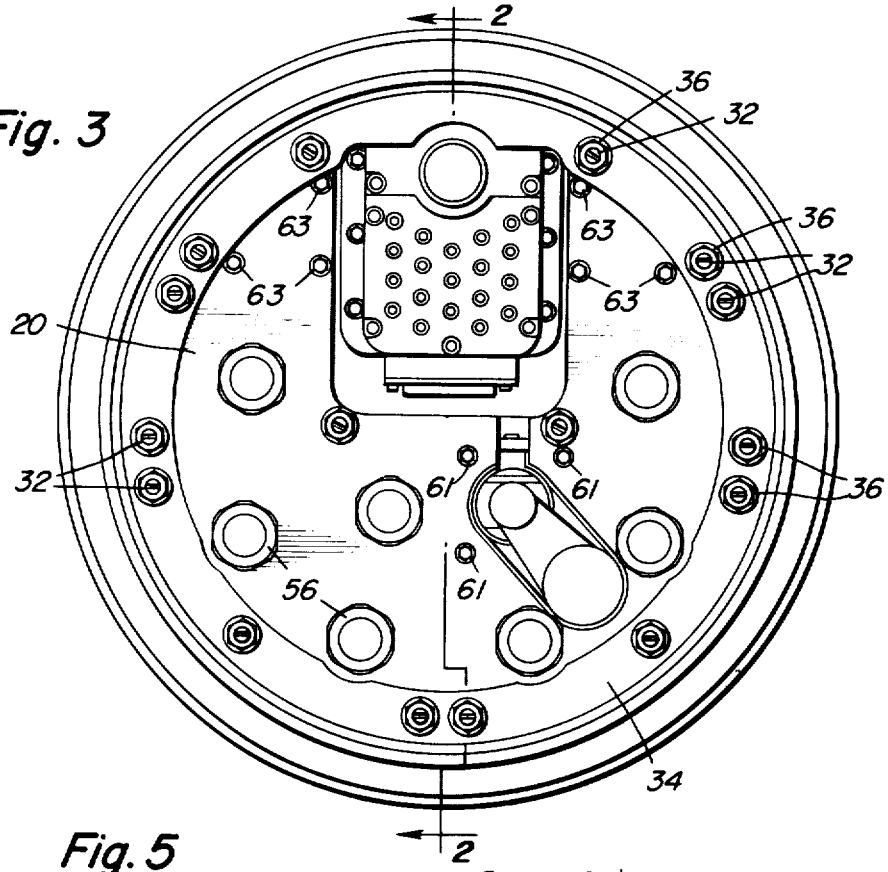
FIG. 3 is a view of the forward or lower section of the present package.

The mounting of components between the forward bulkhead 20 and the central plate 22 is somewhat different. As will be seen, none of the components are rigidly secured to the central plate 22. Thus, in much the same manner as motions of the hull due to shock are not transmitted to the package, displacements of the plates away from and toward each other do not impose any strains on the components. FIG. 7 shows a typical component 55 secured between the forward bulkhead 20 and central plate 22. At its upper end component 55 is provided with a cylindrical projection or boss 51, which, in the assembled condition of the device, enters a mating hole 52 in central plate 22. For connection to plate 20, component 55 is provided with a threaded extension 53 which passes through a hole 54 provided in forward bulkhead 20. A nut 56 is provided which cooperates with extension 53 to secure the component 55 in place. It will be understood that each of the other components 57, 58 and 59 is secured to forward bulkhead 20 in a similar manner. Component 60 in FIG. 6 cooperates with the central plate 22 in the same manner as the other components but differs in that it is secured to foward bulkhead 20 by means of screws 61, FIG. 3. The structure of component 60, which is a pull-out connector, will be described in detail below, wih reference to FIG. 10. Other components 62 are merely secured to the rear side of forward bulkhead 20 by means of fasteners 63, FIG. 3.

After posts 24 have been secured in place and after the components 50, 57, 58, 59, 60 and 62 have been secured to the forward bulkhead 20, the forward bulkhead 20 is fitted into place with the various bosses 51 entering their respective holes 52 and with the threaded ends 32 of posts 24 passing through holes 31.

In order to facilitate electrical interconnection of all the components and modules of the adaption kit system and in order to provide easy access to all electrical connections for testing and troubleshooting, the components are all mounted on the frame so that the electrical terminal plates 64 of the components are peripherally placed. See in particular FIG. 6, and FIGS. 8 and 9. The proper orientation of parts is aided by the provision of locating grooves 66 on the various components which cooperate with pins 67 secured to central plate 22. The connections and terminal boards of some of the components such as 59 and 60 do not face the outside cylindrical periphery of the assembly of course, but remain easily accessible by virtue of the fact that they are not covered by any other components.

Figure 5:
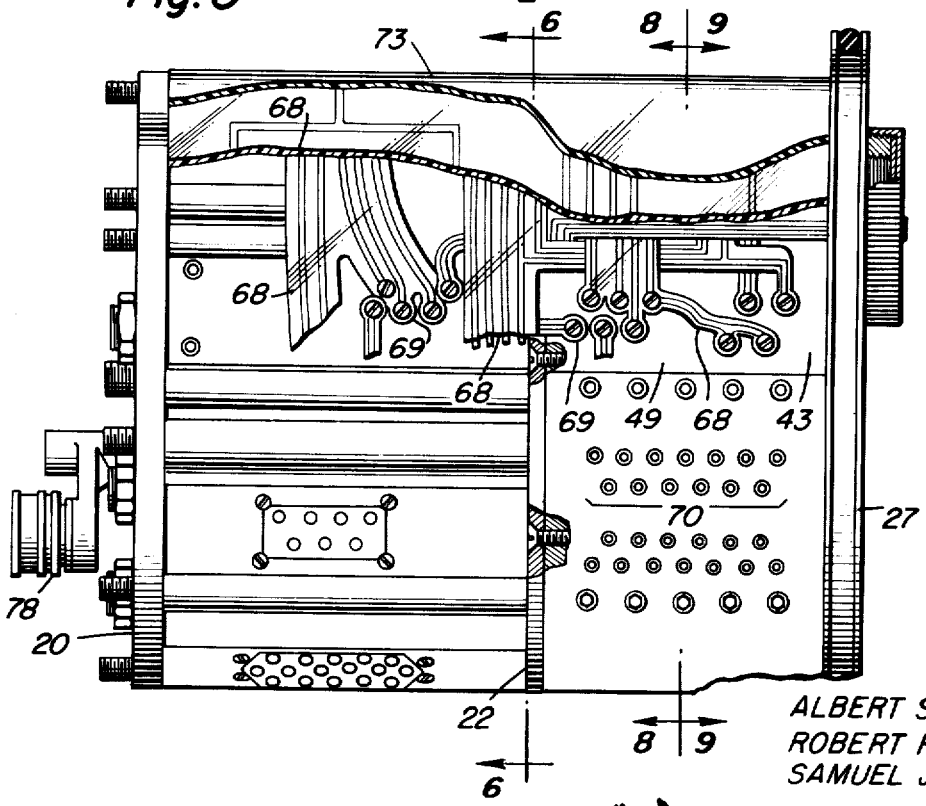
FIG. 5 is a side view of the basic component assembly with some parts removed for clarity.
Figure 6:
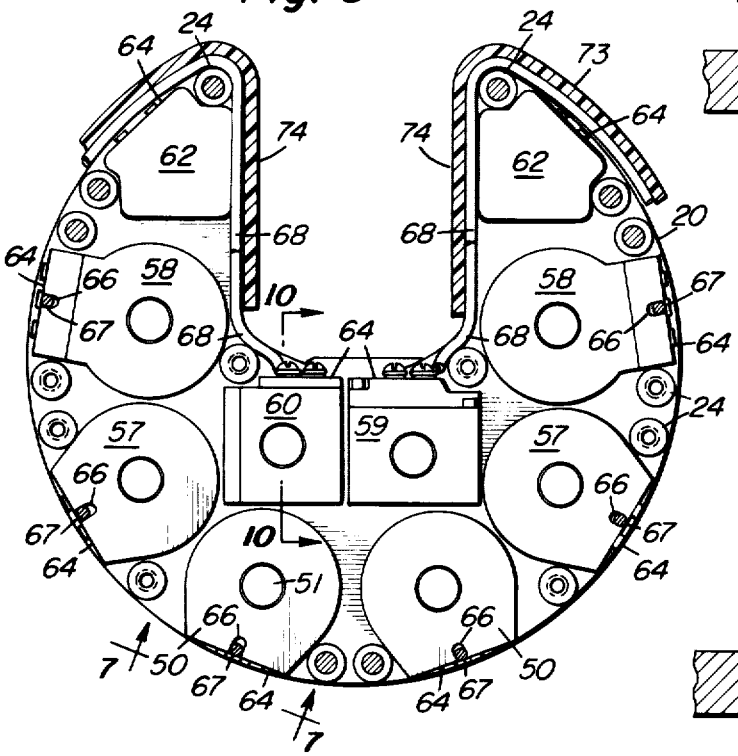
FIG. 6 is a cross-section taken on line 6—6 of FIG. 5.
Figure 7:
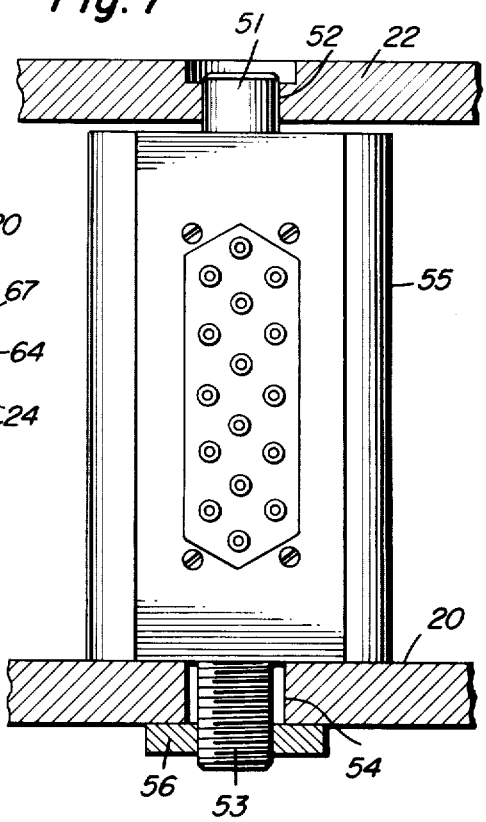
FIG. 7 is a detail view taken generally in the direction shown by the arrows 7—7 in FIG. 6.

The interconnection of the components and modules is accomplished in a minimum of space by means of printed circuit tape cables 68 which wrap around the outside periphery of the assembly, as suggested in FIGS. 5 and 6 for example. The tapes themselves are constructed in known manner, reference being directed to the patent to Turner, Jr., U.S. Pat. No. 3,027,417, issued Mar. 27, 1962, for a teaching of their structure. There may be several overlapping layers of tape cable, depending on the requirements of the system. Electrical connection of the tape cables 68 to the components of the adaption kit is accomplished by means of screws passing through properly placed eyeleted holes 69 in the tape cable ends and secured in tapped terminal holes in terminal boards 64, such as those shown at 70 in FIG. 5. At the top of the assembly, as seen in FIG. 6, the various layers of tape cable are folded over the posts 24 and extended down toward the center of the assembly for connection to components 59 and 60. After all the tape cable has been secured in place, the entire assembly is covered by a protective sleeve 73 which is constructed of an insulating plastic material such as a glass-fiber reinforced plastic. As indicated in FIG. 6 this sleeve 73 is shaped to provide inwardly directed portions 74 which provide insulation and protection for those tape cables which have been extended down into this area. The structure is such that the entire assembly may be slipped into the hull 13 past the battery well 17 as mentioned above.

Figure 10:
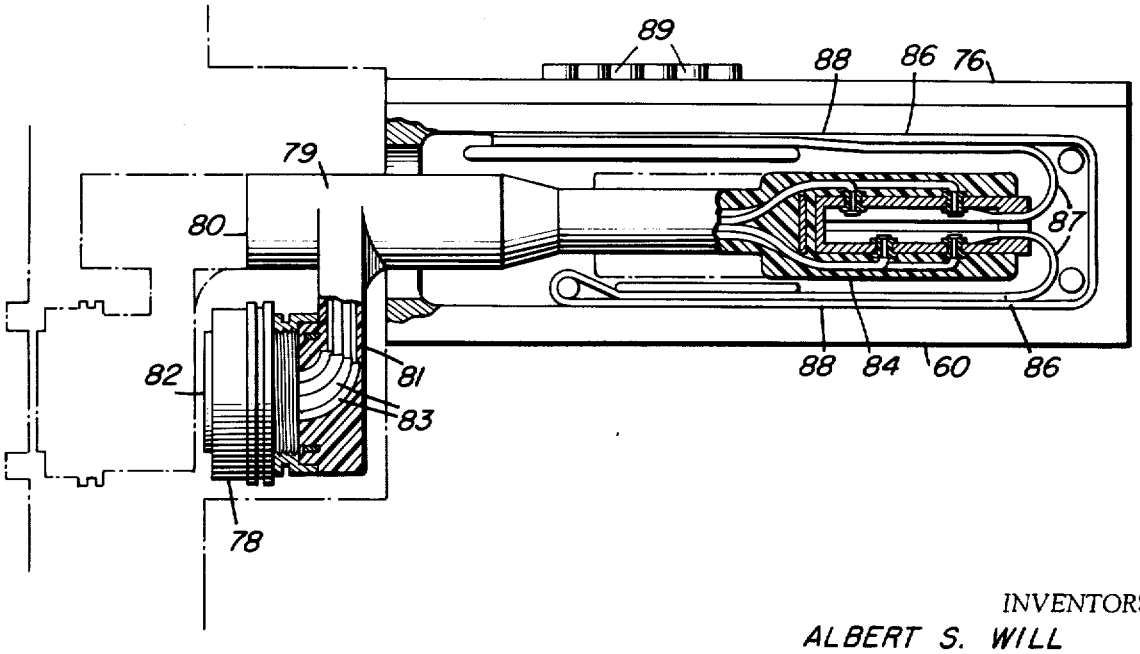
FIG. 10 is a cross-section through pull-out cable portion of the device taken on line 10—10 of FIG. 6.

Component 60 in the present device is an extensible and retractable electrical connector which is provided to facilitate electrical connection of the adaption kit to the warhead. Reference is directed to the patent to Wilbert G. Martini, U.S. Pat. No. 3,157,451, issued Nov. 17, 1964, for a description of the specific structure of component 60. The structure of the connector is shown in FIG. 10 in the present application and comprises a casing 76 adapted to be mounted on the rear side of forward bulkhead 20 in the manner discussed above. Projecting from the casing 76 and extending through opening 77 in forward plate 20 is the movable electrical connector 78. As shown, the connector comprises a rigid body of suitable plastic material 79 extending from housing 76 and terminating in a boss 80. A transversely extending arm 81 serves to carry the connector 82. Electrical leads 83 pass through the arm 81 and the body 79 to the rear portion 84 thereof where they are electrically connected to suitable tape cables 86. As shown, the tape cables 86 are provided with the bight portions 87 and extend along the inner walls 88 of casing 76 to the terminals 89 on the outside of body 76. By means of this construction, the connector may be withdrawn from the adaption kit and connected to the mating connector on the warhead. The adaption kit may then be assembled to the warhead without danger of binding or otherwise damaging the conductors and the cable. The provision on the body 79 of the boss 80 is to provide structural support to the connector 82, in that the boss 80 will bear against the rear wall of the bulkhead when the connector is assembled. In this manner the connector is provided with the support of boss 80 during the high shock of re-entry.

It should be apparent from the foregoing that a packaging system has been described which fully meets all of the requirements stated in the objects above, in that it has a high shock resistance, low vibration transmission, a packaging density which permits inclusion of all necessary components, and is leakproof while providing for a removable power supply. Moreover, the device has provision for easy access of all electrical interconnections for purposes of checking the system, troubleshooting and ease of assembly in order to minimize error.

Obviously, many modifications and variations of the present invention are possible in the light of the above teachings, It is therefore to be understood that within the scope of the appended claims, the invention may be practiced otherwise than as specifically described.

What is claimed is:

1. A cylindrical mechanical package for electrical equipment, comprising:

a plurality of circular supporting plates having a prescribed number of aligned holes therein;

spacer means for supporting said plates in spaced relation;

electrical components supported between said plates either by a direct mounting on a single one of said supporting plates and/or by a mounting between two adjacent supporting plates;

a projecting boss on one end of each of said electrical components fitting slideably in one of said holes in one of said plates; and a projecting threaded shaft on the other end of each of said electrical components projecting through an aligned hole in the other plate; and a nut engaged with said threaded shaft to secure each component rigidly with respect to said other plate;

whereby displacements of said plates away from and toward each other due to shock loadings do not impose any strains on the electrical components;

each of said electrical components having a terminal board thereon, said components being mounted so as to dispose said terminal boards adjacent the cylindrical periphery of the package; and electrical interconnecting means coupling said terminal boards, said interconnecting means consisting of flat tape cables extending around the cylindrical periphery of said package.

2. A leakproof structure for a missile having a cylindrical hull, electrical equipment within said hull, and a battery power supply readily removable from said missile, comprising a battery well having side walls and a bottom wall, said battery well extending from the wall of said hull toward the axis thereof, said side walls being integrally secured to said hull, and said bottom wall being integrally secured to said side walls, an electrical connector in said bottom wall adapted to receive a mating connector on said battery power supply when inserted into said well, said electrical connector being leakproof and connected in leakproof relation to said bottom wall, an annular flange on the inner surface of said hull, a cylindrical package for said electrical equipment adapted to be assembled within said hull by sliding it past said battery well into contact with said flange, the diameter of said package substantially equalling the inner diameter of said hull, said package being provided with a recessed portion extending from one end thereof to permit the sliding of said package past said battery well, whereby maximum use of the volume of said hull is made concomitantly with the retention of a leakproof hull and a readily removable battery power supply, the hull being leakproof even when said battery power supply is removed to allow storage of said missile with a pressurized inert atmosphere therewithin.

3. A missile structure as recited in claim 2 wherein said package comprises a plurality of circular supporting plates, spacer means for supporting said plates in spaced relation, electrical components supported between said plates, each of said components having a terminal board thereon, said components being mounted so as to dispose said terminal boards adjacent the cylindrical periphery of said package, and electrical interconnecting means coupling said terminal boards, said interconnecting means consisting of flat tape cables extending around the cylindrical periphery of said package.

4. A missile structure as recited in claim 3, wherein said recessed portion is defined by generally rectangular notches in at least those supporting plates which must clear said battery well when the package is inserted into said hull, said flat tape cables being folded into said recessed portion and extending along the sides thereof to reach some of said components.

5. A missile structure as recited in claim 4, wherein an insulating protective sleeve surrounds said package, said sleeve having portions extending into said recessed portion in parallel overlying relationship to said tape cables.

6. A missile structure as defined in claim 5, wherein said package is provided with an extensible and retractable electrical cable for establishing electrical connection to another part of said missile.

7. A missile structure as recited in claim 3, wherein some of said electrical components are mounted on a single one of said supporting plates, and some of said components are supported by two of said plates, the mounting means for said latter components comprising aligned holes in said two plates, a projecting boss on one end of each of said components and a projecting threaded shaft on the other end of said components, said projecting boss fitting slideably in one of said holes in one of said plates, said threaded shaft projecting through the aligned hole in the other plate, and a nut engaged with said threaded shaft to secure said component rigidly with respect to said other plate, whereby displacements of said plates away from and toward each oher due to shock loadings do not impose any strains on said components.

* * * * *